US009273274B2

(12) United States Patent
Aouad et al.

(10) Patent No.: US 9,273,274 B2
(45) Date of Patent: Mar. 1, 2016

(54) FABRIC CONDITIONER SHEET COMPRISING A THREE-DIMENSIONAL TEXTURED SUBSTRATE COMPRISING A THERMOPLASTIC FILM

(75) Inventors: Yousef Georges Aouad, Cincinnati, OH (US); Jeremy Wayne Cox, Fort Mitchell, KY (US); Nicola John Policicchio, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1820 days.

(21) Appl. No.: 12/491,315

(22) Filed: Jun. 25, 2009

(65) Prior Publication Data

US 2010/0000116 A1 Jan. 7, 2010

Related U.S. Application Data

(60) Provisional application No. 61/078,062, filed on Jul. 3, 2008.

(51) Int. Cl.
*C11D 3/00* (2006.01)
*C11D 17/04* (2006.01)

(52) U.S. Cl.
CPC ..... *C11D 17/047* (2013.01); *C11D 3/001* (2013.01); *Y10T 156/10* (2015.01)

(58) Field of Classification Search
USPC ..... 34/427; 510/519, 520, 441, 449
See application file for complete search history.

(56) References Cited

U.S. PATENT DOCUMENTS

| | | | | |
|---|---|---|---|---|
| 3,939,538 | A | 2/1976 | Hellman et al. | |
| 4,035,307 | A * | 7/1977 | Fry et al. | 34/345 |
| 4,118,525 | A | 10/1978 | Jones | |
| 4,308,306 | A | 12/1981 | Stahli | |
| 4,735,738 | A * | 4/1988 | Willman | 510/330 |
| 4,839,076 | A | 6/1989 | Willman et al. | |
| 4,861,648 | A * | 8/1989 | Kleinschmidt et al. | 428/40.7 |
| 5,066,413 | A | 11/1991 | Kellett | |
| 6,235,705 | B1 * | 5/2001 | Zembrodt et al. | 510/519 |
| 6,254,932 | B1 | 7/2001 | Smith et al. | |
| 6,689,740 | B1 * | 2/2004 | McGee et al. | 512/2 |
| 7,797,912 | B2 * | 9/2010 | Hammond et al. | 53/453 |
| 7,803,483 | B2 * | 9/2010 | Takami et al. | 429/181 |
| 2003/0069164 | A1 * | 4/2003 | Levinson | 510/499 |
| 2007/0015676 | A1 | 1/2007 | Ogden et al. | |
| 2007/0256253 | A1 | 11/2007 | Ogden et al. | |

FOREIGN PATENT DOCUMENTS

| | | | |
|---|---|---|---|
| EP | 0220 904 | A2 | 5/1987 |
| WO | WO 2007/146555 | A1 | 12/2007 |

OTHER PUBLICATIONS

PCT International Search Report, dated mailed: Oct. 1, 2009, 8 pages.

* cited by examiner

*Primary Examiner* — John McCormack
(74) *Attorney, Agent, or Firm* — Gary J. Foose

(57) ABSTRACT

A fabric conditioning sheet comprising a three-dimensional textured substrate formed from a thermoplastic film which has a substantially planar surface yet defines at least one three-dimensional macroscopic deformation extending away from said substantially planar surface; with a fabric conditioning compound being releasably affixed upon at least a portion of said three-dimensional textured substrate.

19 Claims, 3 Drawing Sheets

FABRIC CONDITIONER SHEET COMPRISING A THREE-DIMENSIONAL TEXTURED SUBSTRATE COMPRISING A THERMOPLASTIC FILM

CROSS REFERENCE TO COPENDING APPLICATIONS

The present application claims priority to copending U.S. Ser. No. 61/078,062 to Aouad et al, filed Jul. 3, 2008, the disclosure of which is hereby incorporated by reference.

BACKGROUND OF THE INVENTION

The consumer desire for dryer sheets capable of providing fabric conditioning benefits during the drying process is known. Conventional dryer sheets are typically made up of non-woven fibrous substrates which are impregnated with fabric conditioner actives such as cationic softening agents, antistatic agents, dispersing agents and fragrance agents. Typical non-woven fibrous substrates are made of polyester. The fabric conditioner is applied to the non-woven fibrous substrate and then dried in an oven so that the dryer sheet is "dry" when ready for use. The fabric conditioners impregnated on the dryer sheet are then released in the course of the drying cycle. Examples of conventional dryer sheets are reported in U.S. Pat. Nos. 3,939,538 to Marshall et al.; 4,118,525 to Jones et al.; 5,066,413 to Kellett; and 6,254,932 to Smith et al.

One problems encountered with conventional dryer sheets using non-woven substrates is that the non-woven substrate are limited in their ability to load fabric conditioner. Fabric conditioner compositions are typically loaded onto conventional dryer sheets by releasably affixing the fabric conditioner composition into the interstitial spaces of the non-woven fibers. The ability of the non-woven substrates to accommodate varying levels of fabric conditioner loading is thus a function of the fiber dimensions and the bonding techniques used to form the non-woven substrate. There remains a continual need for alternative types of substrates which can accommodate larger ranges of fabric conditioner loading levels.

Another problem encountered with conventional dryer sheets is that they tend to retain unacceptable amounts of residual fabric conditioner after being used in one complete automatic drying cycle in an automatic drying cycle. It is believed that as much as 20%, up to 33%, or even up to one half, of the fabric conditioner actives can remain on a dryer sheet after a complete drying cycle. This phenomenon causes some consumers to believe that the residual fabric conditioner present on the used dryer sheets can still be used for additional loads. The problem is that the re-use of sheets designed for single use delivers less fabric conditioning benefit causing consumers to receive inconsistent results when using dryer sheets.

Additional problems with conventional dryer sheets are that the "dried on" fabric conditioners have been reported to exhibit limited softening capability yet require more energy (heat) for proper use when compared to liquid fabric softeners. Recent attempts to address the problems with dry dryer sheets disclose the use of non-woven dryer sheets for delivery of liquid fabric conditioner actives. These problems and examples of attempts to address these problems are reported in U.S. Patent Publ. Nos. 2007/0015676 and 2007/0256273 both to Ogden et al.

Despite the many attempts to address the problems with conventional dryer sheets, these attempts have focused on the use of fibrous substrates or sponge/foam materials. There remains a need for a fabric conditioner sheet which is capable of increased fabric conditioner loading levels yet provides suitable fabric conditioner release rates. Further, there is a need to provide fabric conditioner sheets which can accommodate both liquid and dried fabric conditioners

SUMMARY OF THE INVENTION

One aspect of the present invention provides for a fabric conditioning sheet comprising: a three-dimensional textured substrate comprising a thermoplastic film, said three-dimensional textured substrate forming a substantially planar surface and comprising at least one three-dimensional macroscopic deformation extending away from said substantially planar surface; and a fabric conditioning compound being releasably affixed upon at least a portion of said three-dimensional textured substrate.

Another aspect of the present invention provides for a method of making a fabric conditioner sheet in comprising: providing a three-dimensional textured substrate comprising a thermoplastic film, said three-dimensional textured substrate forming a substantially planar surface and comprising at least one three-dimensional macroscopic deformation extending away from said substantially planar surface; and releasably affixing a fabric conditioner composition upon said at least a portion of said three-dimensional textured substrate.

Yet another aspect of the invention provides for a method of treating fabrics in an automatic drying process comprising: contacting a fabric with a fabric conditioner sheet within the dryer tub of an automatic drying machine, said fabric conditioning article comprising a three-dimensional textured substrate comprising a thermoplastic film, said three-dimensional textured substrate forming a substantially planar surface and comprising at least one three-dimensional macroscopic deformation extending away from said substantially planar surface; and a fabric conditioning coating comprising at least one fabric conditioning active releasably affixed upon said at least a portion of said three-dimensional textured substrate

DETAILED DESCRIPTION OF THE INVENTION

Figure 1:
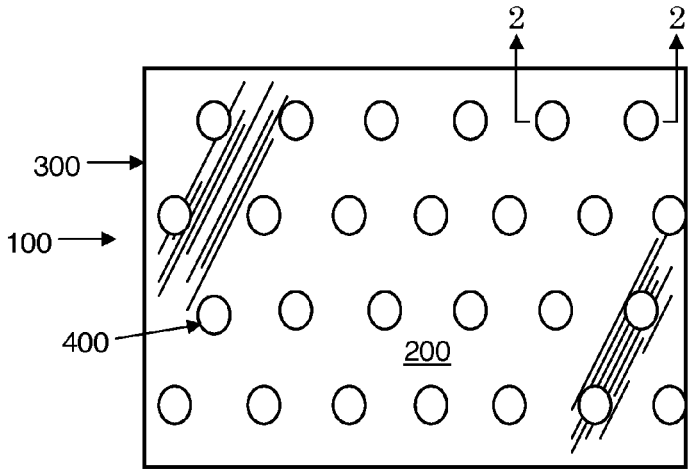
FIG. 1 is a top planar view of a portion of a fabric conditioning sheet in accordance with at least one embodiment of the present invention.

It has importantly been found that the fabric conditioner sheet comprising: a three-dimensional textured substrate comprising a thermoplastic film, said three-dimensional textured substrate forming a substantially planar surface and comprising at least one three-dimensional macroscopic deformation extending away from said substantially planar surface addresses one or more of the problems encountered with conventional dryer sheets. The present invention provides for multiple benefits including, but not limited to, accommodating enhanced fabric conditioner loading levels while providing for sufficient fabric conditioner composition release rates. Further, the present invention can accommodate various forms of fabric conditioner composition, including: a liquid, a foam, a gel, a powder, a solid, a semi-solid, and combinations thereof. Moreover, these different forms of fabric conditioner composition can be releasably affixed onto the present fabric conditioner sheet in a variety of manners allowing for formulation and processing flexibility as well as the ability to control the dispensing behavior when in use.

Definitions:

As defined herein, "microscopic" means that the individual features are not individually discernable when viewed by the human eye from about 18 inches, although a change in texture on a whole may be discernable, while "macroscopic" means that the individual features are individually discernable when viewed by the human eye from about 18 inches. For example, microscopic sized apertures with a rate of between about 30 apertures per linear inch and 100 apertures per linear inch will change the surface texture of a film, but the individual apertures will not be individually discernable by the human eye from a distance of about 18 inches. Likewise, macroscopic sized apertures with a rate of about 5 to about 11 holes per square centimeter will be individually discernable by the human eye from a distance of about 18 inches.

As defined herein, "releasably affixed" refers to a condition where two or more components may be connected to one another and can be separated without destruction of or undue distortion to either component.

As defined herein, "semi-solid" means an intermediate physical form between solid and liquid with intermediate properties such as rigidity, for example a dried layer of fabric conditioner composition which is firm yet flexible.

As defined herein, "substantially planar" means that the sheet or substrate can be curled, folded or bent but still retains the ability to be oriented into a generally flat planar surface. Deformations can be added to the sheet or substrate to give the sheet or substrate a three dimensional characteristic but the sheet or substrate is still generally in a planar sheet shape where the major dimensions of length and width are greater than the thickness.

As defined herein, "three-dimensional" means that the substrate, in addition to having a planar surface, has a third spatial element which extends normal to the plane formed by said substrate. It should be understood that the three-dimensional texture aspect of the present invention is a measurement of the height of this third spatial element, beyond the thickness of the film and/or substrate material forming said substantially planar surface.

FIG. 1 illustrates a portion of a fabric conditioner sheet 100 in accordance with at least one embodiment of the present invention. Said fabric conditioner sheet 100 comprises a three-dimensional textured substrate 200 comprising a thermoplastic film 300 comprising at least one three-dimensional macroscopic deformations 400.

Figure 2:
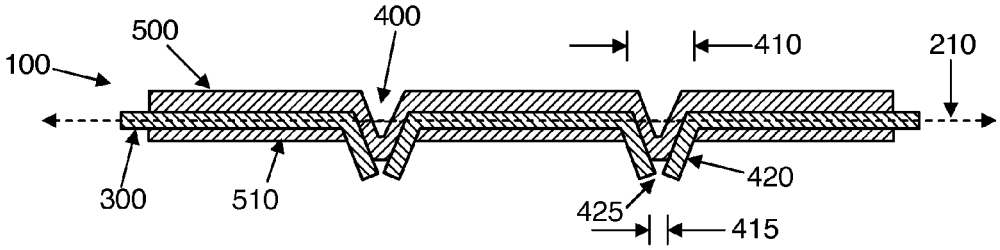
FIG. 2 is a cross sectional view of a portion of another fabric conditioning sheet in accordance with at least one embodiment of the present invention.

FIG. 2 illustrates a cross sectional view of a portion of a fabric conditioner sheet 100 forming a substantially planar surface 210 and comprising a three-dimensional textured substrate comprising a thermoplastic film 300 comprising at least one three-dimensional macroscopic deformation 400 extending away from the substantially planar surface, said three-dimensional macroscopic deformations having a base cross sectional area 410 and an aperture cross sectional area 415. In this embodiment, said at least one three-dimensional macroscopic deformation comprises a funnel shaped aperture comprising a sidewall 420 extending away from said thermoplastic film and terminating in an aperture 425. In this embodiment, the fabric conditioner sheet further comprises a fabric conditioner coating 500 upon at least a portion of at least one side of the thermoplastic film. In one embodiment, the fabric conditioner coating coats an entire side of the fabric conditioner sheet. In another embodiment, the fabric conditioner coating coats the entire fabric conditioner sheet on both sides. The fabric conditioner sheet further comprises a second fabric conditioner coating 510 upon the other portion of the fabric conditioner sheet. The first and second fabric conditioner coatings can comprise the same actives or different actives depending on active compatibility and desired release rates. In addition, more than one coating can be applied to the same portion of the fabric conditioner sheet to provide layering effects.

Figure 3:
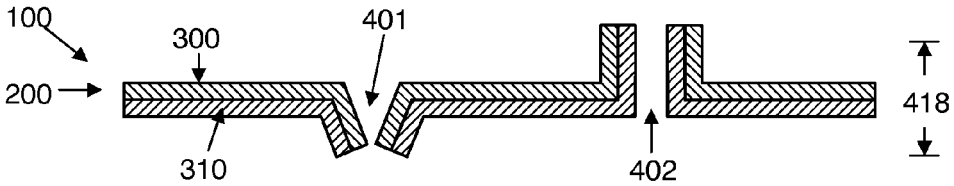
FIG. 3 is a cross sectional view of a portion of another fabric conditioning sheet in accordance with at least one embodiment of the present invention.

FIG. 3 illustrates a cross sectional view of a portion of a fabric conditioner sheet 100 in accordance with at least one embodiment of the present invention. The three-dimensional textured substrate 200 comprises a thermoplastic film 300 and a non-thermoplastic film layer 310 present on at least a portion of at least one side of the thermoplastic film. Said non-thermoplastic film layer 310 comprises a non-woven fibrous substrate. In one embodiment the non-thermoplastic film layer is present on an entire side of the thermoplastic film. One or more of said three-dimensional macroscopic deformations are extending in a downward orientation 401 and one or more of said three-dimensional macroscopic deformations are extending in an upward orientation 402. As shown in this embodiment, the three-dimensional macroscopic deformations can comprise combinations of tapered apertures 401 and non-tapered apertures 402. Further, FIG. 3 shows the three-dimensional substrate thickness 418, which in this embodiment is measured as the lateral distance between the tapered aperture 401 and non-tapered aperture 402 which are extending in opposite directions.

Figure 4:
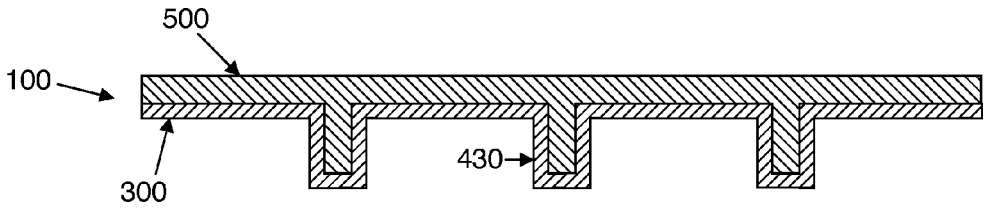
FIG. 4 is a cross sectional view of a portion of another fabric conditioning sheet in accordance with at least one embodiment of the present invention.

FIG. 4 illustrates a cross sectional view of a portion of a fabric conditioner sheet 100 in accordance with at least one embodiment of the present invention. The fabric conditioner sheet comprises a thermoplastic film 300 forming a substantially planar surface comprising at least one rectangular pouch 430. The fabric conditioner sheet further comprises a fabric conditioner coating 500 upon at least one side of the thermoplastic film. In this embodiment, the fabric conditioner coating also fills one or more of said rectangular pouches. The fabric conditioner composition entrapped within the pouch can be part of the coating or can be introduced prior to the sheet being coated. The entrapped fabric conditioner composition can be in liquid, gel, powder or solid form which is restrained within the pouch by the fabric conditioner coating, or can be the same form as the rest of the fabric conditioner coating.

Figure 5:
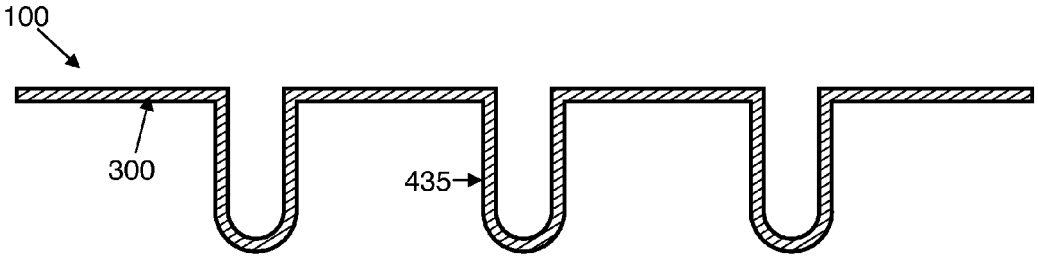
FIG. 5 is a cross sectional view of a portion of yet another fabric conditioning sheet in accordance with at least one embodiment of the present invention.

FIG. 5 illustrates a cross sectional view of a portion of a fabric conditioner sheet 100 in accordance with at least one embodiment of the present invention. In this embodiment, the thermoplastic film 300 forms a substantially planar surface 210 and comprises at least one rounded pouch 435. Those of skill will appreciate that the three-dimensional macroscopic deformations can be reclosing deformations having elastic characteristics such that the pouch or aperture will reclose after being filled with a fabric conditioner composition.

Figure 6:
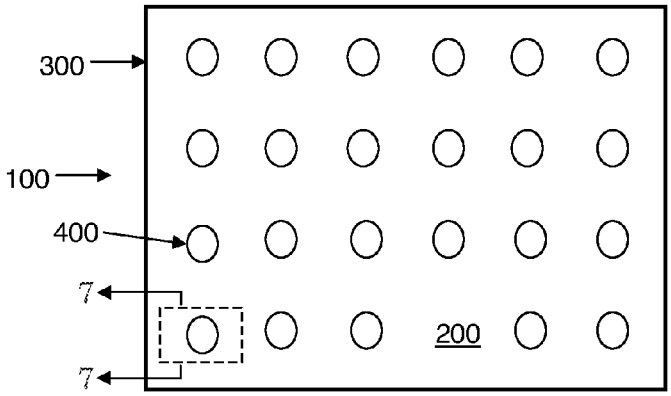
FIG. 6 is a top planar view of a portion of a fabric conditioning sheet in accordance with at least one embodiment of the present invention.

FIG. 6 illustrates a portion of a fabric conditioner sheet 100 in accordance with at least one embodiment of the present invention. Said fabric conditioner sheet 100 comprises a three-dimensional textured substrate 200 comprising a thermoplastic film 300 comprising at least one three-dimensional macroscopic deformation 400 and at least one microscopic deformation 440.

Figure 7:
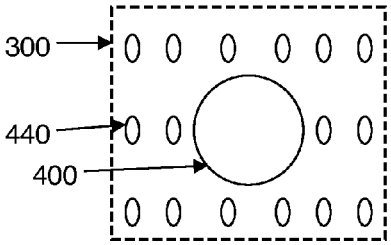
FIG. 7 is an exploded top planar view of a portion of the fabric conditioner sheet of FIG. 6.

FIG. 7 illustrates a exploded view of a portion of the fabric conditioner sheet 100 shown in FIG. 6. The thermoplastic film 300 comprises at least one three-dimensional macroscopic deformation 400 and at least one microscopic deformation.

Figure 8:
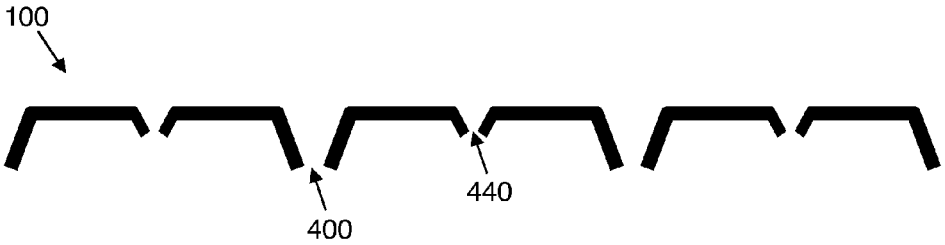
FIG. 8 is a cross sectional view of a portion of a fabric conditioning sheet in accordance with at least one embodiment of the present invention.

FIG. 8 illustrates a cross sectional view of a fabric conditioner sheet comprises a least one three-dimensional macroscopic deformation 400 and at least one microscopic deformation 440.

1. Three-Dimensional Textured Substrate

The three-dimensional textured substrate of the present invention is in the form of a flexible yet substantially planar surface, suitable for being loaded with a fabric conditioner composition. Although the three-dimensional textured substrate is in the form of a substantially planar surface, the substantially planar surface can be folded, curled, or otherwise deformed. As explained herein, the three-dimensional textured substrate comprises at least one layer of a thermoplastic film.

a. Thermoplastic Film

The fabric conditioner sheet of the present invention comprises at least one layer of a thermoplastic film. The fabric conditioner sheet can comprise a single layer of the thermoplastic film or multiple layers of the same or different thermoplastic films. The thermoplastic film is in the form of a sheet which if laid flat forms a substantially planar surface. Further, although the thermoplastic film can have varying film thickness as well as three-dimensional macroscopic deformations, the overall shape of the thermoplastic film is a sheet which has planar or flat surfaces. Those of skill in the art will understand that the thermoplastic film need not remain in a planar orientation as the film is flexible and can easily be deformed as needed.

Suitable materials for use for the thermoplastic film comprise: a film forming polymers comprising: a poly-olefin polymer; a polyethylene, a polyester, a polypropylene, a polylactic acid, derivatives or co-polymers thereof, and mixtures thereof. In one embodiment, the film forming polymer comprises a melting point above about 90° C. to about 300° C., alternatively from about 100° C. to about 150° C. In another embodiment, the film forming polymer comprises a glass transition temperature from about 85° C. to about 300° C., alternatively from about 100° C. to about 150° C. It is believed that despite temperature variances in automatic drying machines commercially available for the home, the dryer activated fabric conditioner sheet of the present invention maintains its structural integrity throughout use. As used herein, maintaining its structural integrity means that the dryer sheet of the present invention does not dissolve, disintegrate, or melt; alternatively, less than 5% of said dryer activated fabric conditioner sheet dissolves, disintegrates, or melts by weight, alternatively, less than 1%. Non-limiting examples of suitable thermoplastic films are provided in U.S. Patent Publ. No. 2004/161586 A1 to Cree et al. at ¶¶ 19-21 and U.S. Pat. Nos. 3,054,148; 4,324,246; 4,324,314; 4,346,834; 4,351,784; 4,463,045; 4,535,020; and 5,006,394.

Non-limiting examples of suitable commercially available three-dimensional textured substrates are available from Tredegar Corporation under the tradename VISPORE®, such as the VISPORE® 6606, Penta Flex L, and X-27373 sheets; from Polymer Group Inc. under the tradename, RETICULON®; or from Gaul Inc. under the tradename ZEOLE®. Additional suitable three dimensional textured substrates are described in U.S. Pat. Nos. 7,163,349; 3,929,135; 4,324,246; 4,342,314; 4,463,045; and 5,006,394. In one embodiment, the three dimensional textured substrate comprises a polyethylene mesh substrate marketed by The Procter & Gamble Company of Cincinnati, Ohio under the tradename of DRI-WEAVE®. A detailed description of such a substrate and a process for making it is disclosed in U.S. Pat. No. 4,463,045

In one embodiment, the thermoplastic film comprises polyethylene, high density polyethylene, low density polyethylene, linear low density polyethylene, and mixtures thereof. In another embodiment, the thermoplastic film comprises a 50/50 blend of low density polyethylene and linear low density polyethylene. In yet another embodiment, the thermoplastic film comprises a blend of (a) 5 to 20 weight % high density copolymer of ethylene; (b) 20 to 70 weight % linear low density copolymer of ethylene; and (c) 20 to 70 weight % highly branched low density ethylene homopolymer. Highly branched low density ethylene homopolymers are as defined in U.S. Pat. No. 4,346,834. Without intending to be bound by theory, it is now believed that thermoplastic films made of polyethylene are suitable for use with commercially available automatic dryer machines as the melting point and the glass transition temperatures of the polyethylene materials are above the operating temperatures of the automatic dryer.

In one embodiment, the thermoplastic film is non-soluble. As defined herein, non-soluble means that the thermoplastic film does not dissolve or disintegrate when in contact with moisture from the laundered fabrics in the automatic drying process or when in contact with the aqueous wash/rinse bath of the washing process. Where the fabric conditioner sheet is designed for use in the dryer, non-soluble thermoplastic films are preferred because a soluble dryer sheet which would dissolve or disintegrate in the presence of water has potential to stain or otherwise damage the fabrics being dried. Consumers are known to prefer dryer sheets which are impregnated with a fabric conditioning composition wherein the dryer sheet remains intact after the drying process is completed such that the consumer can find and dispose of the spent dryer sheet.

Although non-soluble thermoplastic films are preferred from dryer use type applications, in another embodiment, the thermoplastic film can be water soluble or have a water soluble layer laminated thereon. Water soluble thermoplastic films are believed to be suitable where the fabric conditioner sheet is designed for use in the washing process. Suitable water soluble materials include polyvinyl alcohols and other soluble polymers known in the art. Examples of suitable water soluble polymers are provided in U.S. Patent Publ. No. 2007/011063 to Brown et al.

In another embodiment, the thermoplastic film is extruded from a cast die or a blown die as disclosed in U.S. Patent Publ. No. 2004/161586 A1 to Cree et al.

b. Optional Non-Thermoplastic Film Layers

In one embodiment, the fabric conditioner sheet further comprises a non-thermoplastic film layer comprising a non-woven fibrous layer, a woven fibrous layer, a sponge layer, and combinations thereof. In one embodiment, the non-thermoplastic film layer is laminated upon at least a portion of said three-dimensional textured substrate as shown in FIG. 3.

In one embodiment, the non-thermoplastic film layer is laminated upon an entire side of the three-dimensional textured substrate. Without intending to be bound by theory, it is believed that the addition of the non-thermoplastic film layer, to the fabric conditioner sheet of the present invention allows for controlled release of the fabric conditioner composition. For example, where there is a need to provide a first fabric conditioner composition in a liquid form, said first fabric conditioner composition can be releasably affixed onto the three-dimensional deformations of the three-dimensional textured substrate. If there is a need for a second fabric conditioner composition to be in a solid or semi-solid form, Non-limiting examples of three-dimensional textured substrates comprising non-film layers which can be used in accordance with at least one embodiment of the present invention are provided in U.S. Patent Publ. No. 2004/161586 A1 to Cree et al.

2. Three-Dimensional Deformations

The three-dimensional textured substrate comprises at least one three-dimensional macroscopic deformation which extends away from the substantially planar film. In one embodiment, the three-dimensional deformations are transverse to the substantially planar surface; alternatively, they can be oriented perpendicularly to the substantially planar surface. One benefit of having three-dimensional deformations is that they provide a receptacle to store and hold volumes of fabric conditioning compound. Further, the three-dimensional deformations provide "anchoring" sites if the present invention is used with a coating of a fabric conditioning compound. Three-dimensional deformations of varying size and shape and placement, can be selected to provide consumer desirable textures and shapes to the fabric conditioner sheet.

The three-dimensional macroscopic deformation of the present invention comprises a tapered aperture, a non-tapered aperture, a polygon shaped pocket (such as a square, rectangle or pentagon); a rounded pocket, a channel, and combinations thereof. The precise size, shape, and number of three-dimensional macroscopic deformations can be selected to provide various benefits including but not limited to: providing a textured feeling for the user; storing of fabric conditioner composition; providing a textured surface such that a fabric conditioner coating can be layered; and providing for air venting through the thermoplastic film. Non-limiting examples of suitable shapes include: arcoidal shapes including circles, ovals and crescents; polygons such as: triangles, rectangles, pentagons, hexagons, stars; channels, and combinations thereof.

The use of three-dimensional macroscopic deformations in the thermoplastic film allow for increased retention of fabric conditioner composition. For example, the sidewalls extending away from the substantially planar surface allow for increased area to deposit and retain any fabric conditioner composition. Further, the three-dimensional macroscopic deformations can act as pockets or buckets to hold increased volumes of fabric conditioner composition. In one embodiment where the fabric conditioner sheet comprises a liquid fabric conditioner composition, the three-dimensional deformations act as pockets to store the liquid such that liquid is not lost prior to introduction into the dryer.

In one embodiment, the three-dimensional deformation comprises a tapered aperture comprising: a funnel shaped aperture or truncated cone, a tapered truncated tetrahedron or pyramid; a tapered rectangle, square or other geometric shape. Any three-dimensional deformation which extends away from the thermoplastic film, comprising a base cross sectional area and an aperture cross sectional area, wherein the base cross sectional area is larger than the aperture cross sectional area, can be used in accordance with the present invention. See, FIG. 3, element 401. In one embodiment, the three-dimensional deformation comprises a step tapering where the tapered aperture comprises more than one taper, for example a first taper towards the base cross section and a second taper towards the aperture cross sectional, where the second taper is smaller than the first taper. Non-limiting examples of step tapered shapes are available in U.S. Pat. No. 4,194,430 to Muenchinger.

In one embodiment, the aperture cross sectional area is from about 10% to about 90% of the area of the base cross sectional area, alternatively from about 20% to about 50%, alternatively from about 30% to about 40%.

In another embodiment, the three-dimensional deformation comprises a non-tapered aperture. See, FIG. 3, element 402. The non-tapered aperture can have any shape such that the shape and the cross sectional area from the base cross sectional area to the aperture cross sectional area remains substantially the same, i.e., not deviating by more than 10% in area.

One benefit provided by a three-dimensional deformation comprising a tapered or non-tapered aperture is that the aperture at the end of the three-dimensional deformation acts forms a passage way for air to pass through the three-dimensional textured substrate when used in an automatic drying process. The use of apertures within the three-dimensional textured substrate is especially suitable where the fabric conditioner sheet is intended for use with an automatic drying machine. This is believed to be due to the benefit of the apertures allowing air to permeate through the substrate which is desired when used with automatic dryers so the substrate will not unduly obstruct or clog the vent of the automatic drying machine.

In another embodiment, the three-dimensional macroscopic deformation comprises at least one pocket having any of the shapes disclosed herein. It is believed that the pocket is particularly suitable for use with liquid fabric conditioner compositions or any fabric conditioner compositions which tend to leak out or escape prior to use. It is believed that when the present invention is contacted with the tumbling action of the automatic drying process and/or the heat of the automatic drying process, the pockets allow the liquid fabric conditioner composition to escape the substrate and thereby come into contact with the fabrics being dried. Further, when the present invention is used in a washing process, the rinse and/or spin cycle is believed to create sufficient disruption to the sheet of the present invention to allow the liquid fabric conditioner composition to be released.

In one embodiment, the three-dimensional macroscopic deformation is a reclosing deformation. A reclosing deformation as defined herein is biased to remain closed when not in use, i.e. not subjected to the drying conditions of an automatic drying machine. For example, the three-dimensional macroscopic deformation can be in the form of an expandable pouch or sac which has an elastic opening which recloses after any fabric conditioner composition is introduced therein. In another embodiment, where the three-dimensional macroscopic deformation contains a fabric conditioner composition therein, the deformation can be sealed by the addition of a coating layer of solid and/or semi-solid fabric conditioner composition.

In one embodiment, the three-dimensional textured substrate comprises a plurality of said three-dimensional macroscopic deformations, for example from 2 to 15 three-dimensional macroscopic deformations per square cm of said three-dimensional textured substrate, alternatively from about 4 to about 12, alternatively from about 5 to about 11.

In one embodiment, the three-dimensional macroscopic deformation comprises a major lateral dimension of from about 0.2 mm to about 5 mm, alternatively from about 0.5 mm to about 4 mm, alternatively from about 1 mm to about 2 mm. The major lateral dimension can be a diameter or any lateral measurement across the base cross section of the three-dimensional deformation. In one embodiment, where the three-dimensional macroscopic deformation comprises a channel, the channel can stretch for the entire distance of the substrate or can be a discrete section of the substrate for example, having a length of from about 0.2 cm to about 20 cm, alternatively from about 1 cm to about 10 cm, alternatively from about 2 cm to about 5 cm. The width of the channel can be from about 0.05 cm to about 0.2 cm, alternatively from about 0.1 cm to about 0.15 cm.

In one embodiment, the three-dimensional textured substrate comprises at least one three-dimensional macroscopic deformation comprises a base cross sectional area of from about 0.4 $mm^2$ to about 4 $mm^2$, alternatively from about 1 $mm^2$ to about 2 $mm^2$. Where the three-dimensional macroscopic deformation comprises a channel, the base cross sectional area is from about 1 $mm^2$ to about 150 $mm^2$, alternatively from about 10 $mm^2$ to about 10 $mm^2$. The base cross sectional area of the three-dimensional macroscopic deformation is measured at the portion of the thermoplastic film which forms the base of the three-dimensional macroscopic deformation, wherein the base is where the three-dimensional macroscopic deformation begins to extend away from the substantially planar surface created by the thermoplastic film. In one embodiment, the three-dimensional macroscopic deformation comprises a thickness as defined for the thickness of the three-dimensional textured substrate, defined below.

In one embodiment, the three-dimensional microscopic deformations comprise a total base cross sectional area of from about 400 $microns^2$ to about 1000 $microns^2$, alternatively from about 600 $microns^2$ to about 8000 $microns^2$. In one embodiment, the total base cross sectional area is from about 2% to about 50% of the total cross sectional area of the three-dimensional textured substrate, alternatively from about 10% to about 30%, alternatively from about 15% to about 25%. The total cross sectional area of the three-dimensional textured substrate is the total area occupied from a solid sheet covering the same outer perimeter as the present substrate.

The three-dimensional macroscopic deformation of the present invention comprises a void volume of from about 0.1 $mm^3$ to about 2 $mm^3$, alternatively from about 0.5 $mm^3$ to about 1.5 $mm^3$, alternatively from about 0.75 $mm^3$ to about 1 $mm^3$. Where the three-dimensional macroscopic deformation comprises a channel, the void volume can be determined from the cross sectional area mentioned above with a thickness of the three-dimensional textured substrate defined below, for example from about 1 $mm^3$ to about 150 $mm^3$, alternatively from about 10 $mm^3$ to about 10 $mm^3$. The void volume is the volume of the area of a single three-dimensional macroscopic deformation. The three-dimensional macroscopic deformations of the present invention allow for the fabric conditioner composition to fill the void volume, allowing for an increased fabric conditioner loading level.

In one embodiment, all of said plurality of three-dimensional macroscopic deformations are oriented to extend away from the substantially planar surface of the thermoplastic film in the same direction. In one embodiment, a minority of said plurality of the three-dimensional macroscopic deformations are oriented to extend the opposing direction from the majority as shown in FIG. 3. In another embodiment where the thermoplastic film comprises at least one three-dimensional macroscopic deformation and at least one microscopic deformation, all the deformations are oriented in the same direction as shown in FIG. 8. In yet another embodiment, the macroscopic and microscopic deformations are oriented in opposing directions.

3. Dimensions of the Three-Dimensional Textured Substrate

In one embodiment, the three-dimensional textured substrate (without any fabric conditioner loaded thereon) comprises a substrate thickness of from about 0.1 mm to about 3 mm, alternatively from about 0.5 mm to about 1.5 mm, alternatively from about 1 mm to about 1.2 mm. The substrate thickness is a measure of the height of the tallest three-dimensional macroscopic deformation as measured from the side of the substrate opposite the orientation which the three-dimensional macroscopic deformation extends to the tip of the three-dimensional macroscopic deformation. Where a plurality of three-dimensional macroscopic deformations extend in opposite directions, the substrate thickness is the horizontal distance between the two tallest opposing three-dimensional macroscopic deformations.

In one embodiment, the three-dimensional textured substrate has a length dimension of from about 5 cm to about 30 cm, alternatively from about 7.5 cm to about 15 cm, alternatively from about 10 cm to about 12 cm, and a width dimension of from about 5 cm to about 30 cm, alternatively from about 7.5 cm to about 15 cm, alternatively from about 10 cm to about 12 cm. In another embodiment, the three-dimensional textured substrate has a length dimension of about 7 cm and a width dimension of about 12 cm.

4. Fabric Conditioner Loading Levels

In one embodiment, the fabric conditioner sheet comprises a fabric conditioning loading level of from about 50 grams/square meter ("gsm") to about 1000 gsm, alternatively from about 100 gsm to about 700 gsm, alternatively from about 400 gsm to about 500 gsm. As used herein, gsm means grams of said coating per square meter of said three-dimensional textured substrate. As in determining the % of macroscopic void area, the area of said three-dimensional textured substrate is a measure of the area occupied by the outermost perimeter of the three-dimensional textured substrate, i.e. not accounting for the area of said macroscopic or microscopic deformations or any additional substrate material used to form said deformations.

In another embodiment, fabric conditioner sheet comprises a weight ratio of fabric conditioning compound to three-dimensional textured substrate of from about 1:1 to about 50:1. It is understood that the weight ratio can be below 1:1, for example as low as 0.1:1, but it has importantly been found that the three-dimensional textured substrate of the present invention is capable of higher fabric conditioner composition to three-dimensional textured substrate weight ratios which were problematic in the past. It is believed that providing a weight ratio of greater than 1:1, alternatively greater than 5:1, alternatively greater than 10:1, alternatively greater than 20:1, allows for manufacturing flexibility in that the sheets can now be smaller yet store and deliver the same or more fabric conditioner composition, or the sheets can remain the same size as conventional sheets, allowing for delivery of more fabric conditioner compositions.

5. Fabric Conditioner Release Rates

In one embodiment, the fabric conditioner sheet of the present invention has a fabric conditioner release rate which exceeds the release rates obtained by conventional non-woven dryer sheets commercially available in the market. It has surprisingly been found that the current three-dimensional textured substrate comprising said thermoplastic film is capable of enhanced fabric conditioner release rates in part due to fabric conditioner composition being able to be released at a higher rate during a single automatic drying cycle.

In one embodiment, the fabric conditioner sheet of the present invention provides for a fabric conditioner release rate of from about 30% to about 99%, alternatively at least 50%, alternatively at least 75%, alternatively at least 80%, alternatively at least 90%, alternatively at least 95%, alternatively at least 97%, alternatively at lest 99%, by weight, under the Dryer Sheet Fabric Conditioner Release Rate Test as defined herein.

Dryer Sheet Fabric Conditioner Release Rate Test Method is performed by determining the amount of fabric conditioner composition on an un-used fabric conditioner sheet, then as determining how much fabric conditioner composition is released during a test drying cycle.

Steps to determine the amount of fabric conditioner on an un-used fabric conditioner sheet: 1) obtain a 1 gallon water bath of city tap water; 2) heat the water bath to 80° C. and maintain; 3) place an un-used fabric conditioner sheet into the heated water bath; 4) wait 30 minutes; 5) remove the fabric conditioner sheet from the bath and hang in ambient room conditions to allow to air dry for 1 day. The change in weight equals the amount of fabric conditioner on an un-used fabric conditioner sheet.

Test drying cycle steps: 1) weigh an un-used fabric conditioner sheet using a standard lab scale; 2) obtain a load of wet laundered clothing (of 10 white cotton undershirts); 3) place the load of wet laundered clothing into the rotating drum of a Kenmore Heavy Duty Model 110.62512101 electric automatic tumble dryer; 4) place the un-used fabric conditioner sheet into the rotating drum; 5) set and run the automatic tumble dryer on high heat for 50 minutes; and 6) wait 5 minutes after drying cycle is completed, remove clothing and fabric conditioner sheet and weigh on same lab scale. Compare the amount of fabric conditioner on an un-used fabric conditioner sheet to the change in weight from the test drying cycle.

6. Releasably Affixed Fabric Conditioner Composition a. Forms of Fabric Conditioner It has been found that the present invention is capable of loading the fabric conditioner composition at room temperature conditions in the following forms: a liquid, a foam, a gel, a powder, a solid, a semi-solid, and combinations thereof. Those of skill in the art will understand that providing a fabric conditioner sheet capable of delivering fabric conditioner compositions in varying forms allow for controlled delivery of fabric conditioner benefits during the drying process. Without intending to be bound by theory, it is believed that liquid, foam or gel fabric conditioner compositions are dispersed within the drum of the automatic dryer, and thereby onto the fabrics, earlier in the drying process. On the other hand, powder, solid or semi-solid fabric conditioner compositions are believed to require heat and or moisture from the recently laundered fabrics to disperse within the drum of the automatic dryer; thereby occurring later in the drying process. By providing a fabric conditioner sheet suitable for use with varying forms of fabric conditioner compositions, different combinations of the three-dimensional textured substrate and fabric conditioner compositions can be provided to allow for varying product performance benefits based on manufacturing and formulation concerns and consumer need.

b. Manners of Loading the Fabric Conditioner Sheet with the Releasably Affixed Fabric Conditioner Composition The manners in which the fabric conditioner composition is releasably affixed onto said three-dimensional textured substrate comprises: wherein said fabric conditioner composition is at least partially enclosed within said at least one macroscopic deformation; wherein said fabric conditioner composition is a coating layered onto at least a portion of the three-dimensional textured substrate; wherein the manner in which said fabric conditioner composition is releasably affixed onto said optional non-thermoplastic film layer; and combinations thereof.

In one embodiment, the fabric conditioner sheet comprises more than one form of fabric conditioner composition loading, such as: a fabric conditioner composition coating; a fabric conditioner composition stored within the three-dimensional macroscopic deformations; a fabric conditioner composition releasably affixed to an optional fibrous layer; and combination thereof. Those of skill in the art will understand that by varying the form in which a fabric conditioner composition is loaded onto the fabric conditioner sheet a controlled release profile can be achieved. For example, more volatile components, i.e., perfume, tend to become released from dryer sheets early in the typical drying process. In one embodiment, the fabric conditioner sheet comprises a first fabric conditioner composition and a second fabric conditioner composition, wherein the first and second fabric conditioner compositions have actives which have varying volatility and melting points. The first fabric conditioner composition can be at least partially enclosed within said at least one three-dimensional macroscopic deformations, whereas the second fabric conditioner composition can be a coating layered upon at least a portion of the three-dimensional textured substrate, or vice versa. Further, a third fabric conditioner composition can be releasably affixed to the optional fibrous layer.

It is believed that by providing said fabric conditioner composition in different forms and manners, fabric conditioner release rate can be controlled. For example for a more immediate release of the fabric conditioner composition, enclosed volumes of liquid fabric conditioner can be used. For a more delayed release during the drying process, a coating of fabric conditioner can be used. Additionally, any fabric conditioner releasably affixed to a non-woven fibrous layer can also provide a more delayed release rate. These and other modifications to achieve the desired release rate of fabric conditioner composition are within the scope of the invention.

i. Enclosed Fabric Conditioner Composition

In one embodiment, the fabric conditioner composition is at least partially enclosed within said one or more three-dimensional macroscopic deformations. Partially enclosing the fabric conditioner composition protects the fabric conditioner from undesired escape prior to use but also allows for sufficient exposure to the tumbling action and heated air of the drying process. In another embodiment, the fabric conditioner composition is fully enclosed within said one or more three-dimensional macroscopic deformations. With some volatile fabric conditioner actives it may be desired to minimize their exposure to ambient conditions until they are introduced into the drying process to maximize their contact with the laundered fabrics, i.e. volatile perfumes.

ii. Fabric Conditioner Coating

In one embodiment, where the fabric conditioner substrate comprises a fabric conditioner composition in the form of a coating layered upon at least a portion of the three-dimensional deformed substrate, the coating comprises an average coat thickness of from about 0.1 mm to about 5 mm. In one embodiment the fabric conditioner coating comprises an average coating thickness of from about 0.15 mm to about 2 mm, alternatively from about 0.5 mm to about 1.5 mm, alternatively from about 1 mm to about 1.2 mm, alternatively greater than about 0.5 mm, alternatively greater than about 1 mm, alternatively greater than about 2 mm, up to about 4 mm.

It is believed that the three-dimensional textured substrate is uniquely capable of accommodating such coating thickness layers, in part due to the three-dimensional macroscopic deformations. It is believed that the three-dimensional macroscopic deformations provides portions of the substrate wherein a fabric conditioner coating can be anchored onto the substrate such that thicker layers of the coating can be applied whereas they could be susceptible to pealing or flaking off conventional dryer sheets. In one embodiment, the three-dimensional textured substrate has more than one coating of the fabric conditioner composition.

iii. Releasably Affixed onto an Optional Non-Thermoplastic Film Layer

Where the fabric conditioner sheet comprises a non-thermoplastic film layer, such as a fibrous substrate, a fabric conditioner composition can be releasably affixed into the fibrous substrate. Any method of releasably affixing a fabric conditioner composition into/onto a fibrous substrate is within the scope of the invention.

7. Types of Fabric Conditioner Composition

The fabric conditioner composition of the present invention can be any fabric conditioner composition known in the art suitable for use with fabric conditioner sheets. In one embodiment, the fabric conditioner composition comprises one or more fabric conditioner actives. As used herein fabric conditioner active means any material that performs a function or delivers a benefit, such as modifying the physical or chemical properties of the treated material (e.g., fabric). Non-limiting examples of suitable fabric conditioner actives include: perfumes, fabric softening agents, anti-static agents, crisping agents, water/stain repellents, stain release agents, refreshing agents, disinfecting agents, wrinkle resistance agents, wrinkle release agents, odor resistance agents, malodor control agents, abrasion resistance and protection agents, solvents, insect/pet repellents, wetting agents, UV protection agents, skin/fabric conditioning agents, skin/fabric nurturing agents, skin/fabric hydrating agents, color protection agents, dye fixatives, dye transfer inhibiting agents, silicones, preservatives and anti-microbials, fabric shrinkage-reducing agents, brighteners, hueing dyes, bleaches, chelants, antifoams, anti-scum agents, whitening agents, catalysts, cyclodextrin, zeolite, petrolatum, glycerin, triglycerides, vitamins, other skin care actives such as aloe vera, chamomile, shea butter and the like, mineral oils, and mixtures thereof.

In one embodiment, the fabric conditioner active comprises a quaternary ammonium compound. Non-limiting examples of quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. See U.S. Patent Pub. 2005/0192207 at ¶¶ 57-66.

In another embodiment, where a multi-use sheet is desired, the fabric conditioner composition further comprises a carrier composition which allows the fabric conditioner component to transfer to wet laundry, and provides the fabric conditioner composition with a melting temperature or a softening temperature that is greater than the operating temperature of the dryer. Suitable carrier components include ethylene bisamides such as ACRAWAX C™; primary alkylamides; alkanolamides; polyamides; alcohols containing at least 12 carbons: alkoxylated alcohols containing alkyl chain of at least 12 carbons; carboxylic acids containing at least 12 carbons; and derivatives thereof; and mixtures thereof. See id. at ¶¶ 67-75.

In one embodiment, the multiple use fabric conditioning composition of the present invention comprises from about 0.05% to about 15%, preferably from about 0.1% to about 10%; more preferably from about 0.3% to about 6%, and even more preferably from about 0.5% to about 4%, by weight of the fabric conditioning composition, of a blooming perfume composition. The term "blooming perfume composition" as used herein means a perfume composition that comprises at least about 25%, at least about 35%, at least about 45%, at least about 55%, at least about 65%, by weight of the perfume composition, of blooming perfume ingredients, wherein the blooming perfume ingredients are those having a boiling point (B.P.) equal to or lower than about 250° C., more preferably equal to or lower than about 250° C., wherein the B.P. is measured at STP.

In one embodiment, where the fabric conditioner composition is a solid or semi-solid, comprising a carrier material, the fabric conditioner composition further comprises one or more blooming perfumes. It is believed that where the fabric conditioner sheet is used as a multi-use sheet, it can deliver a significantly higher level of volatile perfume ingredients than conventional dryer sheets. It is believed that where the blooming perfume(s) is in an intimate mixture with the solid fabric conditioner composition, the blooming perfume reduces any variation in the rate of release of the actives during the drying process and/or reduces the variation of the strength and character of the perfumes during the lifespan of the fabric conditioner sheet. See, e.g., U.S. Patent Pub. 2005/0192207 and 2005/0192204 to Trihn et al.

In another embodiment, said one or more fabric conditioner actives are provided in an encapsulated form, such as within a microcapsule. The term "microcapsule" is used herein the broadest sense and includes the encapsulation of perfume or other materials or actives in small capsules (i.e., microcapsules), typically having a diameter less than about 300 microns, or less than about 200 microns, or less than about 100 microns. Typically, these microcapsules comprise a spherical hollow shell of water insoluble or at least partially water insoluble material, typically polymer material, within which the active material, such as perfume, is contained. Non-limiting preferred perfume ingredients for use in the neat perfume and/or encapsulated perfume herein are given in U.S. Pat. No. 5,714,137 to Trinh et al.

In one embodiment, where the fabric conditioner comprises a perfume, the perfume comprises a plurality of perfume microcapsules comprising a friable perfume microcapsule, a moisture-activated perfume microcapsule and combinations thereof. In another embodiment, the perfume technology further comprises a free perfume ingredient. Non-limiting examples of suitable dryer sheets comprising a perfume microcapsule are disclosed in U.S. Pat. No. 5,425,887 to Lam et al; and U.S. patent Ser. No. 11/985,636 to Samarcq et al.

8. Process of Making

The fabric conditioning sheet of the present invention can be made by a method comprising the steps of: providing a three-dimensional textured substrate comprising a thermoplastic film, said three-dimensional textured substrate forming a substantially planar surface and forming at least one three-dimensional macroscopic deformation extending away from said substantially planar surface; and applying a fabric conditioning compound releasably affixed upon said at least a portion of said three-dimensional textured substrate.

In one embodiment, wherein said fabric conditioner composition is at least partially enclosed within said at least one macroscopic deformation, the fabric conditioner composition can be in any of the aforementioned forms, suitable to deliver the desired fabric conditioning benefits. A method of making said embodiment comprises: a step of accessing said at least one three-dimensional macroscopic deformation and depositing the fabric conditioner composition. The three-dimensional macroscopic deformation can be in the form of a reclosing pouch or aperture, or can remain open after fabric conditioner composition is deposited. Where the three-dimensional macroscopic deformation comprises a reclosing element, the fabric conditioner composition can be any of the aforementioned forms. Where the macroscopic deformation remains open, it is suitable that the fabric conditioner composition is dried to form a solid or semi-solid form so as not to leak prior to introduction into the drying process.

In one embodiment where the fabric conditioner composition is in the form of a coating, the step of applying a fabric conditioner composition comprises passing the three-dimensional substrate over a rotogravure applicator roll, where the fabric conditioner coating is applied upon the sheet in a thin layer of molten fabric conditioner composition. The coated three-dimensional substrate is then cooled until the fabric conditioner coating solidifies forming a coated fabric conditioner sheet in accordance with the present invention. The cooling can be done at room temperature or at elevated temperatures as needed.

9. Method of Use

The present invention also provides for a method of using the fabric conditioning sheet to provide fabric conditioning benefits to fabrics during the drying process. In one embodiment of the present invention provides for a method of treating fabrics in an automatic drying process comprising: contacting a fabric with a fabric conditioner sheet within the dryer tub of an automatic drying machine, said fabric conditioning article comprising a three-dimensional textured substrate comprising a thermoplastic film, said three-dimensional textured substrate forming a substantially planar surface and comprising at least one three-dimensional macroscopic deformation extending perpendicularly to said substantially planar surface; and a fabric conditioning coating comprising at least one fabric conditioning active releasably affixed upon said at least a portion of said three-dimensional textured substrate.

In one embodiment, the fabric conditioner sheet is suitable for a single use. In another embodiment, the fabric conditioner sheet is suitable for multi-use. As defined herein, "multi-use" means the fabric conditioner sheet can be used to deliver a desired amount of fabric conditioning active to laundry during at least two cycles, or at least about 10 cycles, or at least about 30 cycles. In one embodiment, wherein said fabric conditioner composition is at least partially enclosed within said at least one macroscopic deformation, during the drying process of the automatic dryer, it is believed that the enclosed fabric conditioner compositions escape said at least one macroscopic deformation and come into contact with fabrics being dried. It is believed that the fabric conditioner compositions are released from the three-dimensional textured substrate, due in part to the tumbling action and/or the heated air of the automatic dryer.

Also, within the scope of the present invention is the use of the present fabric conditioning sheets in the wash process. One of skill will understand that fabric conditioner sheets of the present invention can be deposited into the wash and/or rinse cycles of washing process without deviating from intended usages of the fabric conditioner sheets described herein. Further, the present fabric conditioner sheets are suitable for hand washing or a rinsing process.

10. Examples

| | Substrate Dimension | | | Fabric Conditioner | Fabric Conditioner Composition |
|---|---|---|---|---|---|
| | Width (cm) | Length (cm) | Area sqcm | Composition Weight (g) | Loading Level (gsm) |
| Bounce ® Fresh Linen Dryer Sheet | 15.0 | 23.0 | 345.0 | 1.8 | 52.2 |
| Example A | 15.0 | 23.0 | 345.0 | 1.8 | 52.2 |
| Example B | 11.3 | 17.3 | 258.8 | 1.8 | 69.6 |
| Example C | 10.0 | 17.0 | 172.5 | 1.8 | 104.3 |
| Example D | 7.5 | 11.5 | 86.3 | 1.8 | 208.7 |
| Example E | 3.8 | 5.8 | 21.6 | 1.8 | 834.8 |

Examples A-E are prepared by coating a three-dimensional textured substrate with a fabric conditioner coating used in a commercially available dryer sheet. In this example the commercially available dryer sheet is a Bounce® Fresh Linen scent dryer sheet comprising a non-woven substrate. The three-dimensional textured substrate used in Examples A-E is the VisPore® Penta Flex L film available from Tredegar Film Products, Richmond, Va. Examples A-E are in accordance with the present invention.

Examples F-H are three examples of three-dimensional textured substrates in accordance with the present invention.

Example F: an apertured 40 gsm polyethylene thermo-vacuum formed film made of a blend of LLDPE and LDPE (Linear Low density Polytheylene and Low density Polyethylene having a whitener and a resin incorporated surfactant) is obtained from Tredegar Film Products Co. The three dimensional deformations in the form of apertures are formed using a screen having a random pentahex pattern of 50 cells per sq inch and 7 mils land width. The three dimensional textured substrate is coated with a softening agent using a continuous coating process. The resulting coat weight is about 54 g/sqm. The substrate is then cut into sheets about 162 mm wide by about 228 mm long. The Dryer Sheet Fabric Conditioner Release Rate Test Method is conducted, providing a release rate of about 95%.

Example G: an apertured 24 gsm polyethylene hydro-formed film made of a blend of LLDPE and LDPE (Linear Low density Polytheylene and Low density Polyethylene having a whitener and a resin incorporated surfactant) is obtained from Tredegar Film Products Co. The three-dimensional deformations in the form of apertures are formed using two screens one having a 100 mesh forming screen of 112 cells/in$^2$ followed by another screen of 28 cells/in$^2$. The three-dimensional textured substrate is then coated with a softening agent using a continuous coating process. The resulting coat weight is about 54 g/sqm. The film is then cut into sheets about 162 mm wide by about 228 mm long. The Dryer Sheet Fabric Conditioner Release Rate Test Method is conducted, providing a release rate of about 88%.

Example H: an apertured film as described in Example F is coated with a softening agent using a coating process where the resulting coat weight was about 108 g/sqm. The film was cut into sheets half the size of those in Example F. The Dryer Sheet Fabric Conditioner Release Rate Test Method is conducted, providing a release rate of about 98%.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric conditioner sheet comprising:

a. a three-dimensional textured substrate comprising a thermoplastic film, said three-dimensional textured substrate forming a substantially planar surface and comprising at least one three-dimensional macroscopic deformation extending away from said substantially planar surface, wherein said at least one three-dimensional macroscopic deformation is a tapered aperture or a non-tapered aperture; and b. a fabric conditioning compound being releasably affixed upon at least a portion of said three-dimensional textured substrate.

2. The fabric conditioner sheet of claim 1, wherein said three-dimensional textured substrate further comprising one or more non-thermoplastic film layers.

3. The fabric conditioner sheet of claim 1, wherein said at least one three-dimensional macroscopic deformation comprises a base cross sectional area of from about 0.4 $mm^2$ to about 150 $mm^2$.

4. The fabric conditioner sheet of claim 3, where the total base cross sectional area of said at least one three-dimensional macroscopic deformations is from about 2% to about 50% of the total cross sectional area of the three-dimensional textured substrate.

5. The fabric conditioner sheet of claim 1, wherein said at least one three-dimensional macroscopic deformation comprises a void volume from about 0.1 $mm^3$ to about 150 $mm^3$.

6. The fabric conditioner sheet of claim 1, wherein said three-dimensional textured substrate comprises a substrate thickness of from about 0.1 mm to about 3 mm.

7. The fabric conditioner sheet of claim 1, further comprising a fabric conditioner composition loading level of from about 100 gsm to about 1000 gsm.

8. The fabric conditioner sheet of claim 7, further comprising a weight ratio of fabric conditioning compound to three-dimensional textured substrate of from about 1:1to about 50:1.

9. The fabric conditioner sheet of claim 7, wherein said fabric conditioner composition is in the form comprising: a liquid, a foam, a gel, a powder, a solid, a semi-solid, and combinations thereof.

10. The fabric conditioner sheet of claim 7, wherein the manner in which said fabric conditioner composition is releasably affixed to said three-dimensional textured substrate is selected from the group consisting of: wherein said fabric conditioner composition is at least partially enclosed within said at least one macroscopic deformation; wherein said fabric conditioner composition is a coating layered onto at least a portion of the three-dimensional textured substrate; and combinations thereof.

11. The fabric conditioner sheet of claim 10, wherein said fabric conditioning compound is in the form of a coating comprising an average coat thickness of from about 0.1 mm to about 5 mm.

12. The fabric conditioner sheet of claim 7, wherein said fabric conditioner composition comprises a fabric softener, an antistatic agent, a perfume, and combinations thereof.

13. The fabric conditioner sheet of claim 1, wherein said thermoplastic film comprises a melting point from about 90 ° C. to about 300 ° C.

14. The fabric conditioner sheet of claim 13, wherein said thermoplastic film comprises a glass transition temperature from about 85 ° C. to about 300 ° C.

15. The fabric conditioner sheet of claim 14, wherein said thermoplastic film comprises a polyethylene material, a polyester material, a polypropylene material, a polylactic acid material, and mixtures thereof.

16. The fabric conditioner sheet of claim 15, wherein said polyethylene material comprises a high density polyethylene, a low density polyethylene, a linear low density polyethylene, and mixtures thereof.

17. The fabric conditioner sheet of claim 15, further comprising a fabric conditioner release rate of from about 30% to about 99% under the Dryer Sheet Fabric conditioner Release Rate Test as defined herein.

18. A method of making a fabric conditioner sheet comprising the steps of:

a. providing a three-dimensional textured substrate comprising a thermoplastic film, said three-dimensional textured substrate forming a substantially planar surface and comprising at least one three-dimensional macroscopic deformation extending perpendicularly to said substantially planar surface, wherein said at least one three-dimensional macroscopic deformation is a non-tapered aperture; and b. releasably affixing a fabric conditioner composition upon said at least a portion of said three-dimensional textured substrate.

19. A method of treating fabrics in an automatic drying process comprising: contacting a fabric with a fabric conditioner sheet within the dryer tub of an automatic drying machine, said fabric conditioning article comprising a three-dimensional textured substrate comprising a thermoplastic film, said three-dimensional textured substrate forming a substantially planar surface and comprising at least one three-dimensional macroscopic deformation extending away from said substantially planar surface, wherein said at least one three-dimensional macroscopic deformation is a tapered aperture or a non-tapered aperture; and a fabric conditioning coating comprising at least one fabric conditioning active releasably affixed upon said at least a portion of said three-dimensional textured substrate.

* * * * *